US011287127B2

(12) United States Patent
Sapanaro et al.

(10) Patent No.: US 11,287,127 B2
(45) Date of Patent: Mar. 29, 2022

(54) COAL NOZZLE WITH A FLOW CONSTRICTION

(71) Applicant: General Electric Technology GmbH, Baden (CH)

(72) Inventors: Michael Sapanaro, Windsor, CT (US); William P. Bailey, East Granby, CT (US); Jason Jeremy Wailgum, Windsor, CT (US); Joseph Hallstrom, Erlanger, KY (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 10 days.

(21) Appl. No.: 16/635,698

(22) PCT Filed: Jul. 26, 2018

(86) PCT No.: PCT/EP2018/070322

§ 371 (c)(1),
(2) Date: Jan. 31, 2020

(87) PCT Pub. No.: WO2019/025288

PCT Pub. Date: Feb. 7, 2019

(65) Prior Publication Data

US 2020/0309363 A1 Oct. 1, 2020

(30) Foreign Application Priority Data

Jul. 31, 2017 (EP) ..... 17184058

(51) Int. Cl.
*F23C 1/00* (2006.01)
*F23C 13/06* (2006.01)

(52) U.S. Cl.
CPC ..... *F23C 1/00* (2013.01); *F23C 13/06* (2013.01); *F23C 2900/03005* (2013.01)

(58) Field of Classification Search
CPC .. F23C 1/00; F23C 13/06; F23C 2900/03005; F23D 1/00; F23D 2201/20
See application file for complete search history.

(56) References Cited

U.S. PATENT DOCUMENTS 3,881,962 A * 5/1975 Rubinstein ..... H01L 35/00 136/209
4,274,587 A * 6/1981 Cioffi ..... F23D 1/00 110/104 B (Continued)

FOREIGN PATENT DOCUMENTS

CN 103 868 068 A 6/2014
DE 197 29 607 A1 1/1999

(Continued)

OTHER PUBLICATIONS

International Search Report of the International Searching Authority for PCT/EP2018/070322 dated Aug. 17, 2018.

*Primary Examiner* — David J Laux
(74) *Attorney, Agent, or Firm* — Grogan, Tuccillo & Vanderleeden, LLP

(57) ABSTRACT

The invention concerns a pulverized solid fuel, in particular coal, nozzle (10) comprising an inlet opening (12) for receiving a stream of coal/air mixture (16) and an outlet opening (14) for discharging said stream (16) into a burner. The inlet opening (12) and the outlet opening (14) are fluidically connected by a flow section (18), and a flow cross section (20) of the flow section (18) varies along a flow direction (22) of the stream of coal/air mixture (16). The flow section (18) comprises a flow constriction (24) with a, preferentially globally, minimal flow cross section (26). The flow constriction (24) is fluidically located between the inlet opening (12) and the outlet opening (14) and the flow section (Continued)

(18) has a flow cross section (20) that, in particular continuously, increases from the flow constriction (24) to the outlet opening (14).

17 Claims, 6 Drawing Sheets

(56) References Cited

U.S. PATENT DOCUMENTS

| | | | | |
|---|---|---|---|---|
| 4,500,281 | A | 2/1985 | Beardmore | |
| 5,104,310 | A | 4/1992 | Saltin | |
| 5,829,367 | A | 11/1998 | Ohta et al. | |
| 5,842,426 | A | 12/1998 | Ohta et al. | |
| 6,024,030 | A | 2/2000 | Okamoto et al. | |
| 6,053,118 | A | 4/2000 | Okamoto et al. | |
| 6,152,051 | A * | 11/2000 | Kiyama | F23D 1/00 110/262 |
| 2004/0114300 | A1 * | 6/2004 | Wang | H05H 1/34 361/247 |
| 2005/0255419 | A1 | 11/2005 | Belashchenko et al. | |
| 2013/0233212 | A1 * | 9/2013 | Hamasaki | F23D 1/00 110/261 |
| 2015/0226431 | A1 * | 8/2015 | Ristic | F23Q 9/00 431/6 |
| 2020/0056780 | A1 * | 2/2020 | Watanabe | F23C 7/006 |

FOREIGN PATENT DOCUMENTS

| | | |
|---|---|---|
| EP | 0 687 857 A2 | 12/1995 |
| JP | H01 217109 A | 8/1989 |

* cited by examiner

COAL NOZZLE WITH A FLOW CONSTRICTION

BACKGROUND OF INVENTION

The present invention relates to a pulverized solid fuel, in particular coal, nozzle, that can be applied in a burner for burning pulverized coal, wherein the nozzle is designed in a manner which minimizes the formation of oxides of nitrogen in the burning process.

PRIOR ART

In solid fueled firing systems powdered solid fuel, typically coal, is blown into a burner in a stream of air, this stream of air typically being referred to as primary air. The stream of air transports the pulverized coal and also provides at least a part of the oxygen needed for burning the coal. Such burners are typically used in furnaces or in boilers that create steam for various applications, such as creating electricity.

A wide variety of nozzle and burner designs have been developed over the years and some of the burners used in furnaces, boilers and the like have been especially suited for burning pulverized coal. One of the major problems in burning pulverized coal as well as other fossil fuels is the production of oxides of nitrogen in the combustion process. It is a goal in burner design to achieve reduction of the amount of oxides of nitrogen that are formed in the burning of the pulverized coal. Such oxides, known as NOX cause air pollution and are generally objectionable.

From U.S. Pat. No. 8,955,776 a stationary nozzle for solid fueled furnaces is known comprising several flat guide vanes arranged parallel to each other in the exit area of the nozzle to direct the flow of primary air and coal particles into the furnace.

Currently, there is a need for an improved coal nozzle assembly resulting in a burning process that produces less pollutants, like for example NOx, in the flue gas.

SUMMARY OF THE INVENTION

It is an objective of the present invention to provide a pulverized solid fuel, in particular coal, nozzle that allows for clean burning of pulverized coal, in particular a low NOx burning of coal. It is further an objective that this nozzle is simple in construction and has a high service life.

This objective is reached with a pulverized solid fuel, in particular coal, nozzle according to claim 1.

The pulverized solid fuel, in particular coal, nozzle according to the current invention is a nozzle for solid fuel injection comprising an inlet opening for receiving a stream of a coal/air mixture and an outlet opening for discharging said stream into a burner, wherein the inlet opening and the outlet opening are fluidically connected by a flow section, wherein a flow cross section of the flow section is varying along a flow direction of the coal/air mixture and wherein the flow section comprises a flow constriction with a, preferentially globally, minimal flow cross section, characterized in that the flow constriction is fluidically located between the inlet opening and the outlet opening and in that the flow section has a flow cross section that increases from the flow constriction to the outlet opening. Optionally the flow section has a flow cross section that continuously increases for at least 50% of the extension of the flow section between the flow construction and outlet opening, in particular continuously increases for at least 60% of the extension of the flow section between the flow construction and outlet opening, in particular continuously increases for at least 80% of the extension of the flow section between the flow construction and outlet opening. Optionally the part of the flow section with the flow cross section that continuously increases is one uninterrupted part of the flow section. Optionally the flow section has a flow cross section that continuously increases over the entire extension of the flow section between the flow construction and outlet opening.

The mixture of pulverized coal and air is blown into the Inlet opening of the nozzle and then flows in the flow direction along the flow section. When the stream of a coal/air mixture reaches the flow constriction the airstream is at its maximum flow speed. When the stream of a coal/air mixture has passed the flow constriction its flow speed decreases due to the increase in flow cross section. This decrease in flow speed allows flame propagation into the nozzle. Therefore during operation of the nozzle the flame front is located within the nozzle which offers advantageous burning conditions for volatile matter in the fuel. The coal can ignite in a fuel rich environment and volatile matter in the fuel can be burned off such that a chemistry can be produced that reduces NOx that is produced via the later stages of the combustion.

Optionally, the flow section comprises a first expansion section and a second expansion section fluidically located between the flow constriction and the outlet opening, wherein the rate of change of the flow cross section of the first expansion section is higher than the rate of change of the flow cross section of the second expansion section. The described embodiment with the two expansion sections offers preferable flow characteristic such that the flame front is located within the nozzle but kept from propagating beyond the flow constriction.

Optionally, the first expansion section is arranged before the second expansion section in flow direction, preferably wherein the first expansion section is abutting the second expansion section. By this arrangement it is achieved that the flow speed of the stream of a coal/air mixture rapidly decreases up to the flow constriction is passed.

Optionally, the flow cross section of the first expansion section and/or the second expansion section increases proportionally to the square of the respective extend in flow direction of the first expansion section and/or the second expansion. This is for example achieved if the respective expansion section is of circular cross-section and the diameter of this cross section increases linearly with the extent in flow direction.

The described increase in flow cross section leads to advantages flow characteristics in the nozzle.

Optionally, the flow cross section of the flow section is at least locally, preferentially along its entire length, of circular shape. By this shape the nozzle can be easily manufactured while the circular shape of the cross section is beneficial for the flow characteristics and especially the increase in flow cross section in combination with a circular shape of the cross section needs to beneficial flow characteristics that improve the flame propagation into the nozzle.

Optionally, an igniter is located in the flow section of the nozzle, preferentially between the flow constriction and the outlet opening. By this the stream of a coal/air mixture can be directly ignited in the novel and the operation of the nozzle and all flow characteristics is such that the flame front is located within the nozzle.

Optionally, the wall of the flow section of the nozzle between the flow constriction and the outlet opening is at least locally, preferentially along its entire extend in flow direction, coated with a coating that comprises a catalyst, suitable for catalyzing the reaction of coal with oxygen. By this the burning of the coal is enhanced and the flame front location within the nozzle is facilitated.

Optionally, the nozzle comprises cooling means, wherein the cooling means are preferentially arranged in flow direction at least also between the flow constriction and the outlet opening. By this the heating up of the material the nozzle can be kept low and the service life of the nozzle is increased. The location of the flame front within the nozzle leads to a higher degree of heating up of the components of the nozzle as compared to a nozzle operation in which the flame front is located outside the nozzle such that implementing the above-mentioned cooling means is in particular advantageous in combination with the location of the flame front within the nozzle. Such cooling means can be cooling fins or channels through which a cooling medium is supplied to the area of the nozzle that are intended to be cooled. Optionally there can be a gas that is blown around the nozzle to achieve cooling from the outside of the nozzle.

Optionally, the cooling means comprise a fluid, in particular liquid, coolant jacket, preferentially wherein the coolant jacket surrounds the wall of the flow section at least also between the flow constriction and the outlet opening and/or wherein the coolant jacket surrounds the wall of the flow section before and after the flow constriction and/or wherein the coolant jacket extends in flow direction from before the flow constriction to the outlet opening. Such a coolant jacket allows surrounding the components to be cooled with the fluid coolant. Preferentially the coolant jacket is designed to accommodate a liquid coolant. The use of a liquid coolant offers the benefit of a high cooling rate due to the generally high specific heat capacity of liquids. Such a liquid coolant can be water which offers the benefit of low costs, universal availability and high specific heat capacity.

Optionally, the coolant jacket has a coolant flow direction opposite to the flow direction of the stream of coal/air mixture. By this it is achieved that the coolant and its coldest state is in contact with the hottest parts of the nozzle such that an advantageous rate of heat transfer is achieved.

Optionally, the nozzle comprises at least one coolant pipe with an inlet near the inlet opening of the nozzle and an outlet into the coolant jacket, wherein the outlet is preferably located near the outlet opening of the nozzle. By this the coolant can be introduced into the coolant pipe near the inlet opening where the temperature is within reasonable boundaries during operation of the nozzle and the coolant is then transported via the coolant pipe to the outlet opening where intensive cooling of the nozzle is beneficial.

Optionally, the coolant jacket comprises a thermal expansion compensation joint for compensating different thermal expansions of different segments of the nozzle due to unequal temperature distribution along the nozzle during operation. When viewed from the Inlet opening to the outlet opening of the nozzle during operation of the nozzle there might be a strong gradient in temperature such that the nozzle deforms non-uniformly along its extent. The above-mentioned thermal expansion compensation joint is constructed so it can accommodate varying thermal expansion rates of the individual sections of the nozzle which is beneficial for the service life of the nozzle and in particular the coolant jacket.

Optionally, the thermal expansion compensation joint comprises a corrugated tube. In this way the thermal expansion compensation joint can be fabricated in straightforward and low-cost fashion such that the liquid coolant based cooling can be implemented in the nozzle with limited expenses. Furthermore such a corrugated tube offers a high degree of flexibility and therefore can accommodate large differences in thermal expansions of different components.

Optionally, the nozzle comprises a pivoting mechanism that allows for pivoting of the outlet opening relative to the inlet opening. By this the direction of the stream of coal/air mixture or in ignited condition the flame exiting the nozzle can be directly the desired while the attachment of the nozzle can be stationary.

Optionally, the nozzle comprises a cylindrical segment and in flow direction behind the cylindrical segment a converging conical segment and in flow direction behind the converging conical segment a first diverging conical segment and in flow direction behind the first diverging conical segment a second diverging conical segment wherein the first diverging conical segment has a higher angle of divergence than the second diverging conical segment. Optionally two, preferentially all, of the above-mentioned segments of the nozzle abut with the respective previous segment. By this a easily implemented construction of the nozzle is achieved. Such a nozzle can be fabricated using readily available parts and therefore is cheap in construction and high in durability.

Optionally, the flow section is at least between the flow constriction and the outlet opening, preferentially along is entire length, insert-free. This allows the formation of an advantageous flow profile in the nozzle. Insert-free refers to a flow section or a part of it in which there is no inserts in the cross section of the flow section that would cause significant abrupt change in the cross-sectional area of the flow section.

DETAILED DESCRIPTION OF THE DRAWINGS

Figure 1:
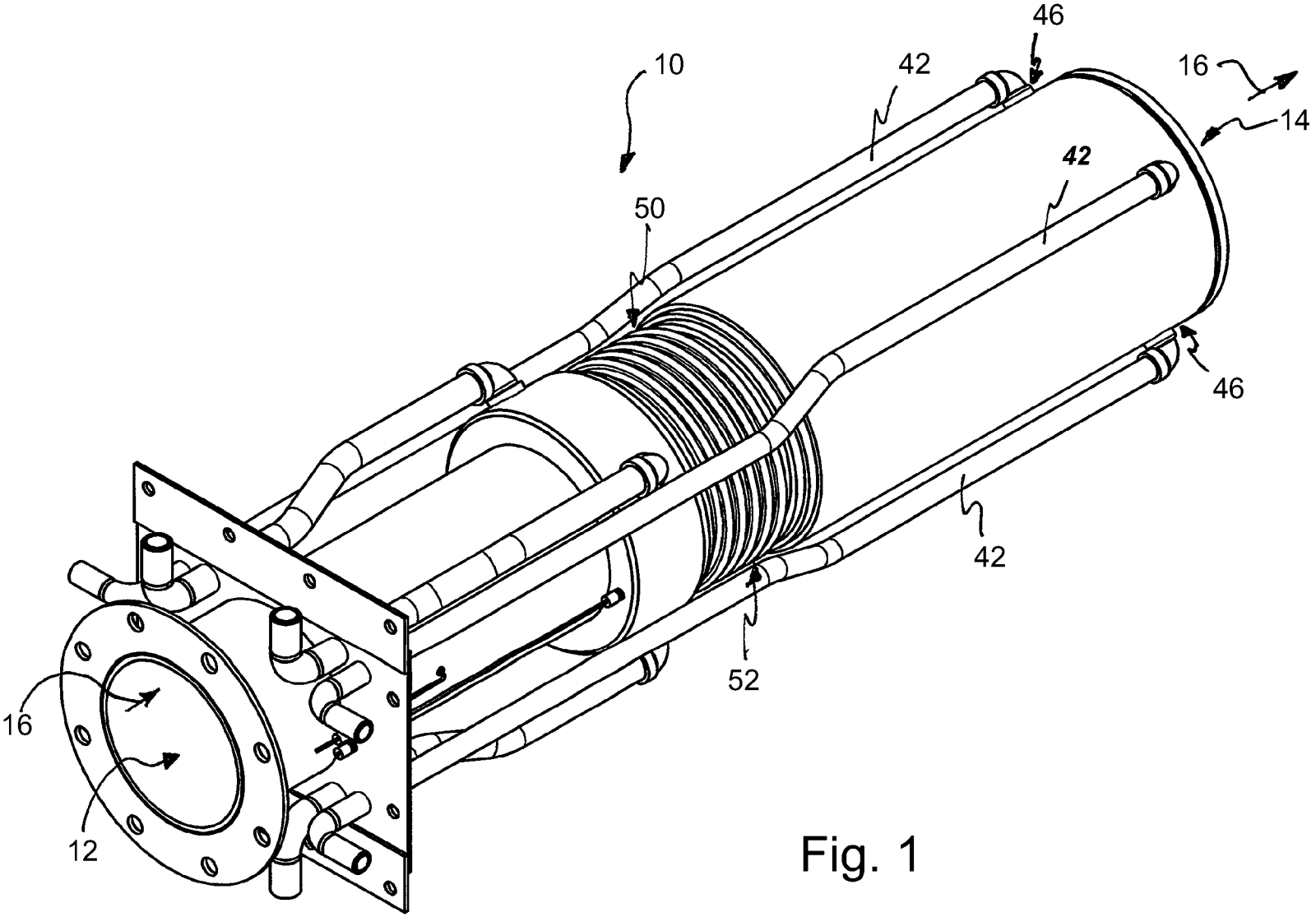
FIG. 1: A perspective view of a nozzle according to the invention.

FIG. 1 shows perspective view of a nozzle 10 for solid fuel injection according to the invention. The nozzle 10 comprises an inlet opening 12 and an outlet opening 14. The inlet opening 12 is for receiving a stream of coal/air mixture 16 which is symbolically indicated via an arrow. The outlet opening 14 is for discharging said stream 16 into a not shown burner.

Figure 3:
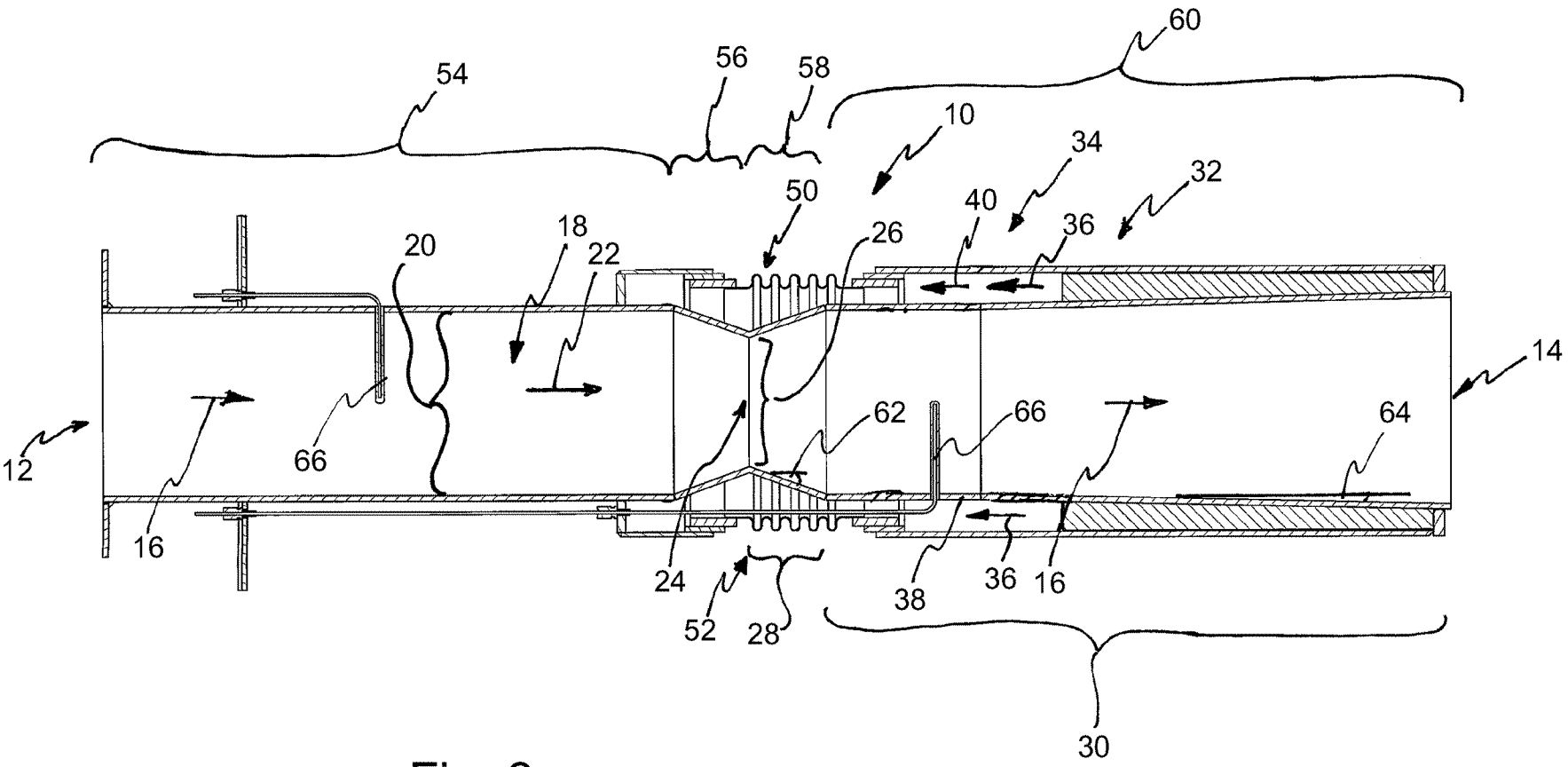
FIG. 3: cut view of the nozzle of FIGS. 1 and 2.

The inlet opening 12 and the outlet opening 14 are fluidically connected by a flow section 18, as shown in FIG. 3. A flow cross section 20 of the flow section 18 is varying along a flow direction 22 of the stream of coal/air mixture 16. The flow section 18 comprises a flow constriction 24 with a, in the embodiment of the figures, globally minimal flow cross section 26 i.e. the flow cross section 20 has its minimum at the minimal flow cross section 26. The flow constriction 24 is fluidically located between the inlet opening 12 and the outlet opening 14, i.e. the stream of coal/air mixture 16 first passes the inlet opening 12 then the flow constriction 24 and then the outlet opening 14. The flow cross section 20 of the flow section 18 increases from the flow constriction 24 to the outlet opening 14. In the current embodiment the flow cross section 20 of the flow section 18 continuously increases over the entire extension of the flow section 18 from the flow constriction 24 to the outlet opening 14.

The flow section 18 comprises a first expansion section 28 and a second expansion section 30 fluidically located between the flow constriction 24 and the outlet opening 14. The rate of change of the flow cross section 20 of the first expansion section 28 is higher than the rate of change of the flow cross section 20 of the second expansion section 30. The first expansion section 28 is arranged before the second expansion section 30 in flow direction and abuts the later.

The flow cross section 20 of the first expansion section 28 and the second expansion section 30 increases proportionally to the square of the respective extend in flow direction 22, since the cross sectional area of the flow cross section 20 in each of the expansion section 28, 30 is circular and the diameter of this circular cross-sectional area increases proportional to the extent in flow direction 22.

The nozzle 10 comprises cooling means 32 which in the current embodiment are implemented as a coolant jacket 34. The cooling means 32, i.e. the coolant jacket 34 is arranged in flow direction at least also between the flow constriction 24 and the outlet opening 14. More specifically the coolant jacket extends from before the flow constriction 24 along the extend of the nozzle 10 until close to the outlet opening 14.

The coolant jacket 34 is constructed to accommodate a liquid coolant 36 indicated symbolically via an arrow. The coolant jacket 34 surrounds a wall 38 of the flow section 18. The coolant jacket 34 extends in this surrounding fashion in flow direction 22 from before the flow constriction 24 to near the outlet opening 14.

The coolant jacket 34 is constructed such that a coolant flow direction 40 within the coolant jacket 34 is opposite to the flow direction 22 of the stream of coal/air mixture 16.

The nozzle 10 comprises several coolant supply lines 42 in the form of pipes. The coolant supply lines 42 each have an inlet 44 near the inlet opening 12 of the nozzle 10 and an outlet 46 into the coolant jacket 34, wherein the outlet 46 is located near the outlet opening 14 of the nozzle 10. The coolant 36 leaves the coolant jacket 34 coolant exit lines 48. In the current embodiment the coolant jacket 34 is adapted and arranged to be used with water as the coolant 36. Using other liquids as a coolant 36 is possible and within the scope of this invention.

The coolant jacket 34 comprises a thermal expansion compensation joint 50 for compensating different thermal expansions of different segments of the nozzle 10 due to unequal temperature distribution along the nozzle 10 during operation.

The thermal expansion compensation joint 50 in turn comprises a corrugated tube 52.

The nozzle in the current embodiment comprises a cylindrical segment 54 and in flow direction 22 behind the cylindrical segment 54 a converging conical segment 56 and in flow direction 22 behind the converging conical segment 56 a first diverging conical segment 58 and in flow direction 22 behind the first diverging conical segment 58 a second diverging conical segment 60 wherein the first diverging conical segment 58 has a first angle of divergence 62 that is higher than a second angle of divergence 64 of the second diverging conical segment 60.

The flow section 18 in the current embodiment is insert-free. Insert-free refers to a flow section 18 or a part of it in which there is no inserts in the cross section of the flow section 18 that would cause significant abrupt change in the cross-sectional area of the flow section 18. As can be seen in FIG. 3 there are thermo-elements 66 extending into the flow section 18. However these thermo-elements 66 are of such small the dimensions, that they do not cause significant abrupt change in the cross-sectional area of the flow section 18. Therefore they are considered not to constitute inserts within the meaning of the current invention. That static or dynamic mixers arranged in the flow section 18, however, would be considered to constitute inserts within the meaning of the current invention.

Figure 2:
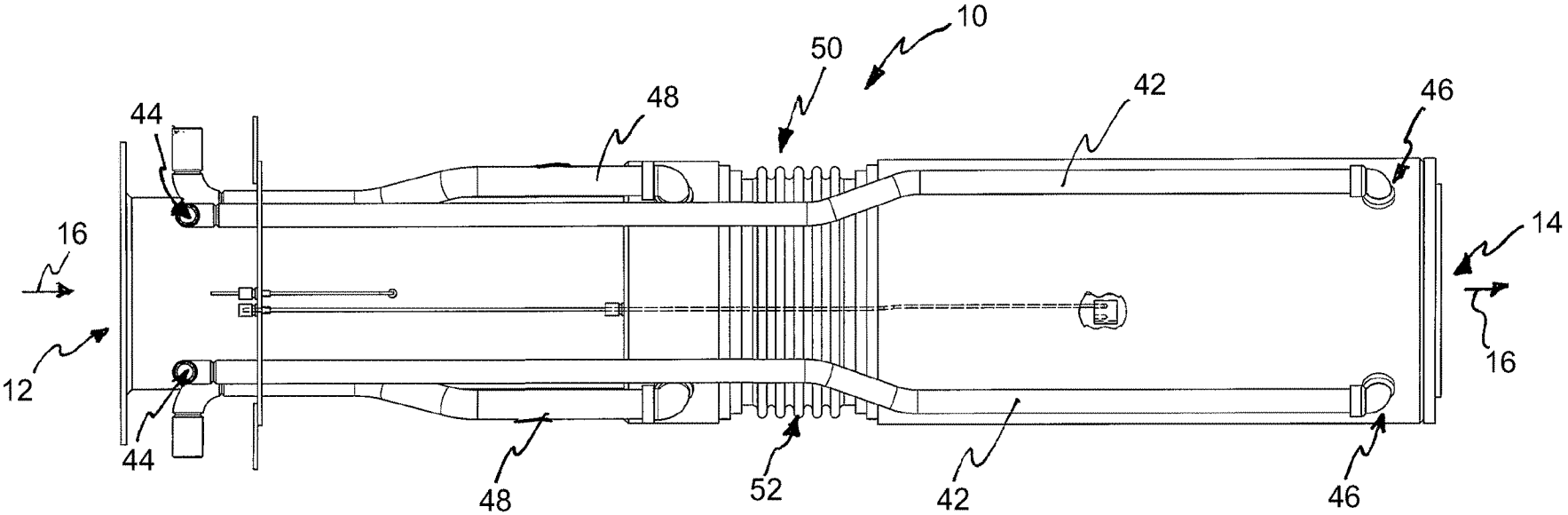
FIG. 2: A side view of the nozzle of FIG. 1.
Figure 4:
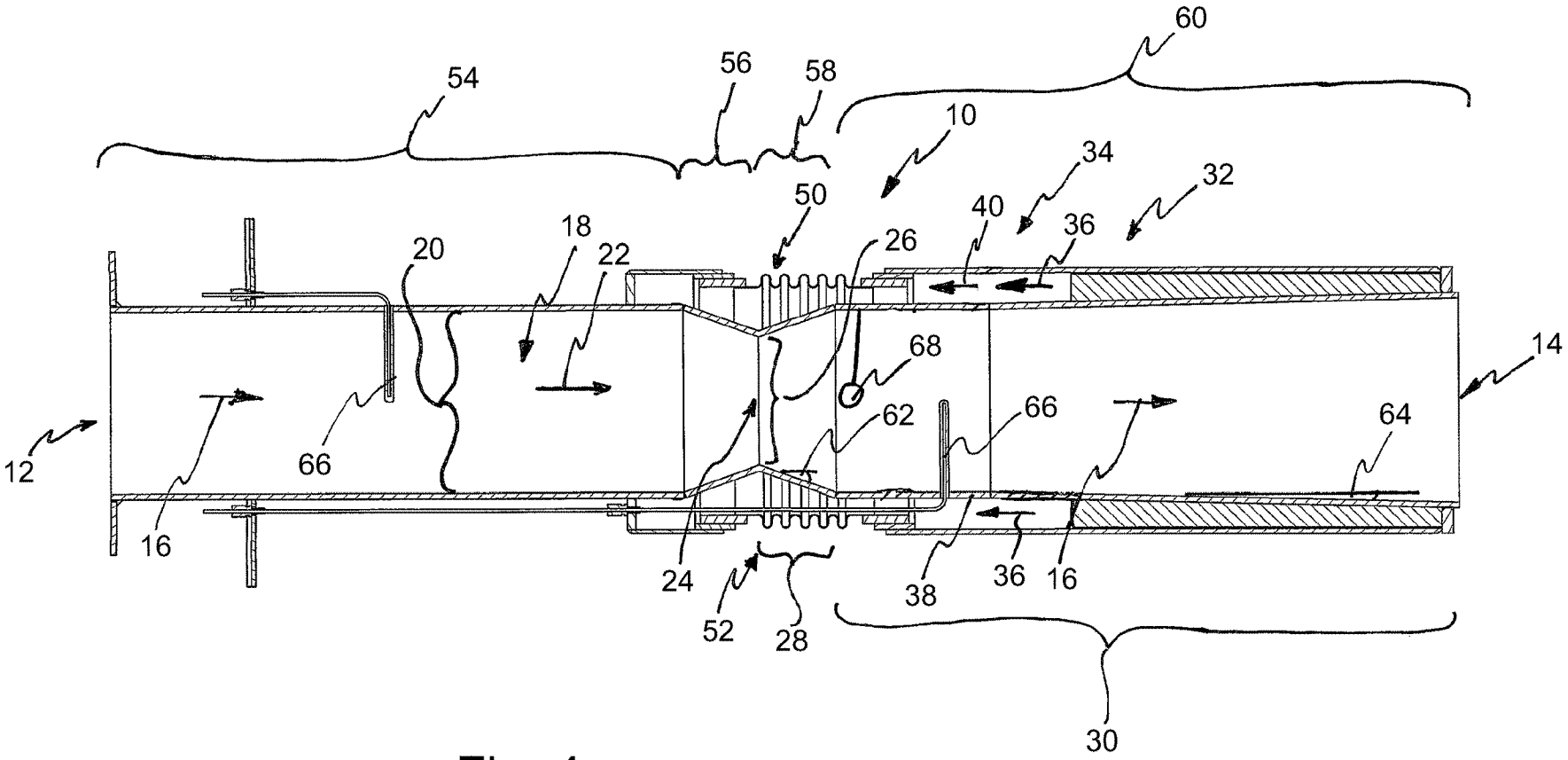
FIG. 4: an alternative embodiment of a nozzle in the view of FIG. 3.

FIG. 4 shows an embodiment that is constructed similar to the embodiment of FIGS. 1 to 3. In the embodiment of FIG. 4 the nozzle 10 additionally comprises an igniter 68 (shown schematically) which is located in the flow section 18 of the nozzle 10. More specifically in the current embodiment the igniter 68 is located between the flow constriction 24 and the outlet opening 14.

Figure 5:
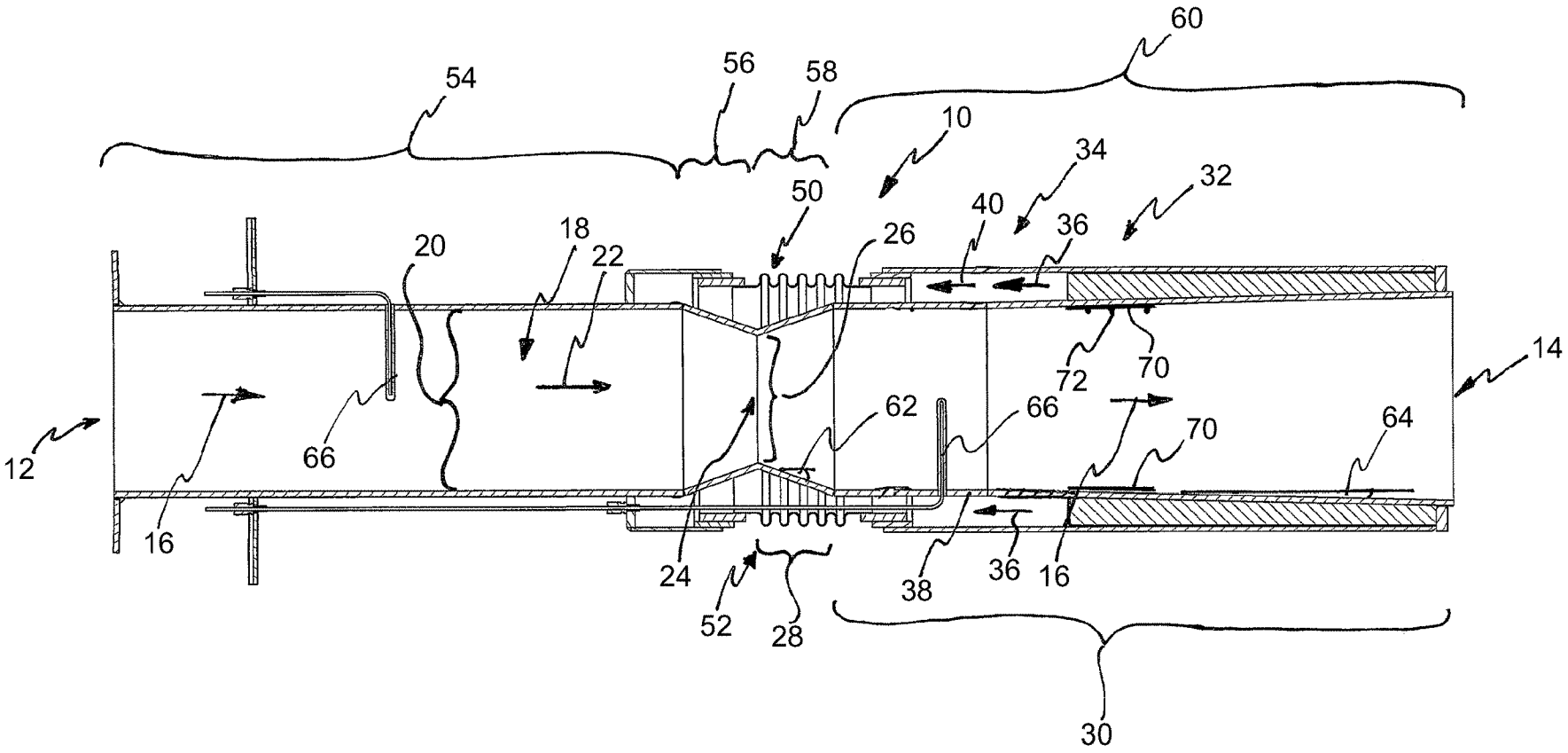
FIG. 5: an alternative embodiment of a nozzle in the view of FIG. 3.

FIG. 5 shows an embodiment that is constructed similar to the embodiment of FIGS. 1 to 3. In the embodiment of FIG. 5 the wall 38 of the flow section 18 of the nozzle 10 between the flow constriction 24 and the outlet opening 14 is coated with a coating 70 (shown schematically) that comprises a catalyst 72, suitable for catalyzing the reaction of coal with oxygen.

Figure 6:
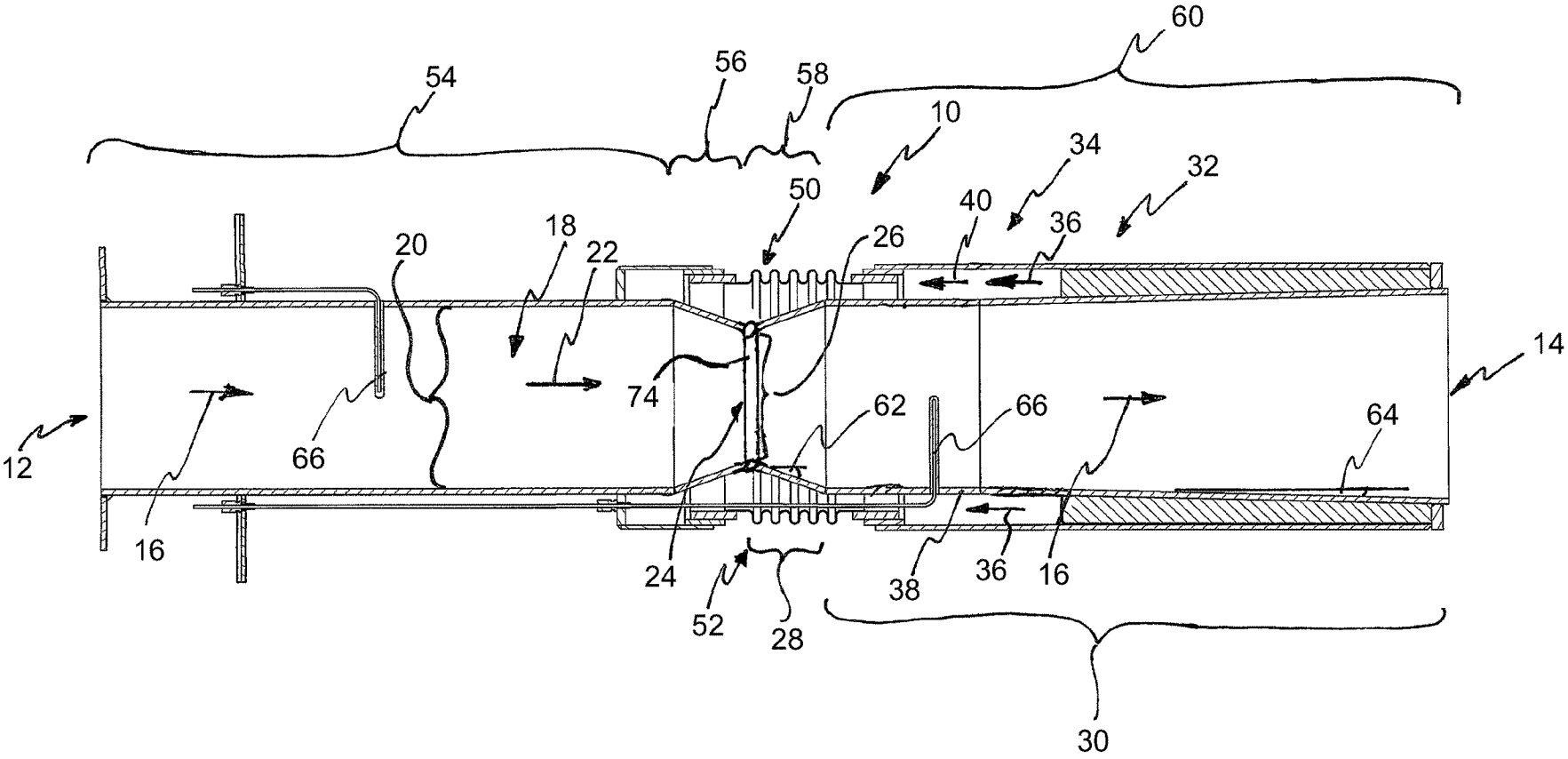
FIG. 6: an alternative embodiment of a nozzle in the view of FIG. 3.

FIG. 6 shows an embodiment that is constructed similar to the embodiment of FIGS. 1 to 3. In the embodiment of FIG. 6 the nozzle comprises a pivoting mechanism 74 (shown schematically) that allows for pivoting of the outlet opening 14 relative to the inlet opening 12.

Obviously it is also within the scope of the current invention to combine the igniter 68 with the coating 70 and/or the pivoting mechanism 74 or to combine the coating 70 with the pivoting mechanism 74.

In the operation of the embodiments described above the stream of coal/air mixture 16 is blown into the Inlet opening 12 then propagate along the nozzle 10 passes the flow constriction 24 and subsequently reduces its flow speed. Either the stream of coal/air mixture 16 is ignited by the igniter 68 and the flame front is located within the nozzle 10 already due to this ignition and remains there due to the reduced flow speed behind the flow constriction 24 or the stream of coal/air mixture 16 is ignited outside of the nozzle 10, i.e. after it has passed the outlet opening 14. In the later case due to the reduced flow speed behind the flow constriction 24 the flame front propagates into the nozzle 10 and remains between the flow constriction 24 and the outlet opening 14 during operation of the nozzle 10.

Since the flame front is located within the nozzle 10 burning of the coal or other solid fuels begins in a fuel rich environment. This burning in a fuel rich environment produces a chemistry that is transported along with the stream of coal/air mixture 16 that is already burning and reduces the NOx formation during the burning taking place outside of the nozzle 10. In total this leads to a significant reduction in the NOx formation during burning of the stream of coal/air mixture 16.

Auxiliary air can be blown along the outside of the nozzle 10 and can enhance the burning process.

The coating 70 comprising the catalyst 72, if present, facilitates the location of the flame front within the nozzle 10 since it decreases the amount of energy necessary to start the reaction between coal and oxygen, i.e. the burning of the coal.

LIST OF REFERENCE NUMERALS

10 nozzle
12 inlet opening

14 outlet opening
16 stream of coal/air mixture
18 flow section
20 flow cross section
22 flow direction
24 flow constriction
26 minimal flow cross section
28 first expansion section
30 second expansion section
32 cooling means
34 coolant jacket
36 liquid coolant
38 wall of flow section
40 coolant flow direction
42 coolant supply line
44 inlet
46 outlet
48 coolant exit lines
50 thermal expansion compensation joint
52 corrugated tube
54 cylindrical segment
56 converging conical segment
58 first diverging conical segment
60 second diverging conical segment
62 first angle of divergence
64 second angle of divergence
66 thermo-elements
68 igniter
70 coating
72 catalyst
74 pivoting mechanism

The invention claimed is:

1. A pulverized solid fuel nozzle, comprising: an inlet opening for receiving a stream of coal/air mixture and an outlet opening for discharging the stream of coal/air mixture into a burner, wherein the inlet opening and the outlet opening are fluidically connected by a flow section, wherein a flow cross section of the flow section is varying along a flow direction of the stream of coal/air mixture, and wherein the flow section comprises a flow constriction with a globally, minimal flow cross section, wherein the flow constriction is fluidically located between the inlet opening and the outlet opening, and the flow cross section of the flow section continuously, increases over an entire extension of the flow section from the flow constriction to the outlet opening, wherein the flow section comprises a first expansion section and a second expansion section fluidically located between the flow constriction and the outlet opening, wherein the rate of change of the flow cross section of the first expansion section higher than the rate of change of the flow cross section of the second expansion section, wherein a wall of the first expansion section is in direct, physical contact with a wall of the second expansion section in the flow section after the flow constriction in the flow direction.

2. The pulverized solid fuel nozzle according to claim 1, wherein the first expansion section is arranged before the second expansion section in the flow direction, wherein the first expansion section is abutting the second expansion section.

3. The pulverized solid fuel nozzle according claim 1, wherein the flow cross section of the first expansion section and/or the second expansion section increases proportionally to the square of the respective extend in flow direction of the first expansion section and/or the second expansion.

4. The pulverized solid fuel nozzle according to claim 1, wherein the cross sectional area of the flow cross section of the flow section comprises a circular shape.

5. The pulverized solid fuel nozzle according to claim 1, further comprising an igniter located in the flow section of the nozzle between the flow constriction and the outlet opening.

6. The pulverized solid fuel nozzle according to claim 5, wherein the igniter is located in the flow section proximate the flow constriction, distal to the outlet opening.

7. The pulverized solid fuel nozzle according to claim 1, wherein the wall of the flow section of the nozzle between the flow constriction and the outlet opening is coated with a coating that comprises a catalyst for catalyzing the reaction of coal with oxygen.

8. The pulverized solid fuel nozzle according to claim 1, further comprising cooling means, wherein the cooling means is arranged in the flow direction between the flow constriction and the outlet opening.

9. The pulverized solid fuel nozzle according to claim 8, wherein the cooling means comprises a fluid coolant jacket, wherein the coolant jacket has an arrangement that comprises one or more of:

wherein the coolant jacket surrounds the wall of the flow section between the flow constriction and the outlet opening, wherein the coolant jacket surrounds the wall of the flow section before and after the flow constriction, and wherein the coolant jacket extends in flow direction from before the flow constriction to near the outlet opening.

10. The pulverized solid fuel nozzle according to claim 9, wherein the coolant jacket comprises a thermal expansion compensation joint for compensating different thermal expansions of different segments of the nozzle due to unequal temperature distribution along the nozzle during operation.

11. The pulverized solid fuel nozzle according to claim 10, wherein the thermal expansion compensation joint comprises a corrugated tube.

12. The pulverized solid fuel nozzle according to claim 10, wherein the thermal expansion compensation joint is placed over the wall of the flow section above the flow constriction.

13. The pulverized solid fuel nozzle according to claim 8, wherein the nozzle comprises at least one coolant supply line with an inlet near the inlet opening of the nozzle and an outlet into the coolant jacket, wherein the outlet is located near the outlet opening of the nozzle.

14. The pulverized solid fuel nozzle according to claim 1, wherein the outlet opening is configured to pivot relative to the inlet opening.

15. The pulverized solid fuel nozzle according to claim 1, wherein the nozzle comprises a cylindrical segment, a converging conical segment in the flow direction behind the cylindrical segment, a first diverging conical segment in the flow direction behind the converging conical segment, a second diverging conical segment in the flow direction behind the first diverging conical segment, wherein the first diverging conical segment has a first angle of divergence that is higher than a second angle of divergence of the second diverging conical segment.

16. The pulverized solid fuel nozzle according to claim 1, wherein the flow section is at least between the flow constriction and the outlet opening, and is insert free along its entire length.

17. The pulverized solid fuel nozzle according to claim 1, further comprising thermo-elements disposed in the flow section between the inlet opening and the flow constriction.

* * * * *